US007255477B2

(12) United States Patent
Arnell

(10) Patent No.: US 7,255,477 B2
(45) Date of Patent: Aug. 14, 2007

(54) LOCKABLE BAG WITH PLASTIC ZIPPER CLOSURE AND ZIPPER CLOSURE CLIP

(75) Inventor: Patrick Arnell, Calgary (CA)

(73) Assignee: Bemis Company, Inc., Minneapolis, MN (US)

( * ) Notice: Subject to any disclaimer, the term of this patent is extended or adjusted under 35 U.S.C. 154(b) by 0 days.

(21) Appl. No.: 10/393,761

(22) Filed: Mar. 21, 2003

(65) Prior Publication Data

US 2004/0184681 A1 Sep. 23, 2004

(51) Int. Cl.
*B65D 33/16* (2006.01)

(52) U.S. Cl. ..... 383/64; 383/61.2; 383/69; 383/78

(58) Field of Classification Search ..... 24/585.12, 24/DIG. 50, 30.5 R, 399, 400; 383/61.2, 383/63, 64, 69, 78
See application file for complete search history.

(56) References Cited

U.S. PATENT DOCUMENTS 1,959,318 A * 5/1934 Sundback ..... 24/400
3,346,883 A * 10/1967 Ersek ..... 4/661
3,426,396 A 2/1969 Laguerre
3,808,649 A * 5/1974 Ausnit ..... 383/63
4,541,117 A * 9/1985 Ashbeck ..... 383/64
4,744,674 A * 5/1988 Nocek ..... 383/63
4,791,710 A * 12/1988 Nocek et al. ..... 24/585.12
4,964,739 A * 10/1990 Branson et al. ..... 383/5
5,020,194 A 6/1991 Herrington et al.
5,070,583 A 12/1991 Herrington
5,140,796 A * 8/1992 Pope ..... 53/390
5,809,621 A 9/1998 McCree et al.
5,851,071 A * 12/1998 Arnell ..... 383/63
6,581,253 B2 * 6/2003 ErkenBrack ..... 24/428
6,874,935 B2 4/2005 Edelman et al.
7,029,178 B2 4/2006 Gzybowski
2004/0047524 A1 3/2004 Stolmeier et al.
2004/0064923 A1 4/2004 Gzybowski
2005/0025392 A1 2/2005 Stolmeier

OTHER PUBLICATIONS

International Search Report and Written Opinion for PCT/CA2004/000409, Jul. 26, 2004, 12 pages.

* cited by examiner

*Primary Examiner*—Robin A. Hylton
(74) *Attorney, Agent, or Firm*—Brinks Hofer Gilson & Lione

(57) ABSTRACT

A locking bag includes an envelope with a single opening defined between a pair of side wall edges. A pair of plastic zipper portions are disposed on opposite sides of the single pair of side wall edges. A zipper closure clip is slidably attached to the single pair of side wall edges at one corner of the opening of the bag. The zipper closure clip is adapted to clamp the two portions of the plastic zipper together when the zipper closure clip is slid along the opening of the bag. The two plastic zipper portions include suitable means to make the closing of the opening permanent. In one embodiment, the zipper closure is removable from the bag after the bag is permanently closed.

11 Claims, 2 Drawing Sheets

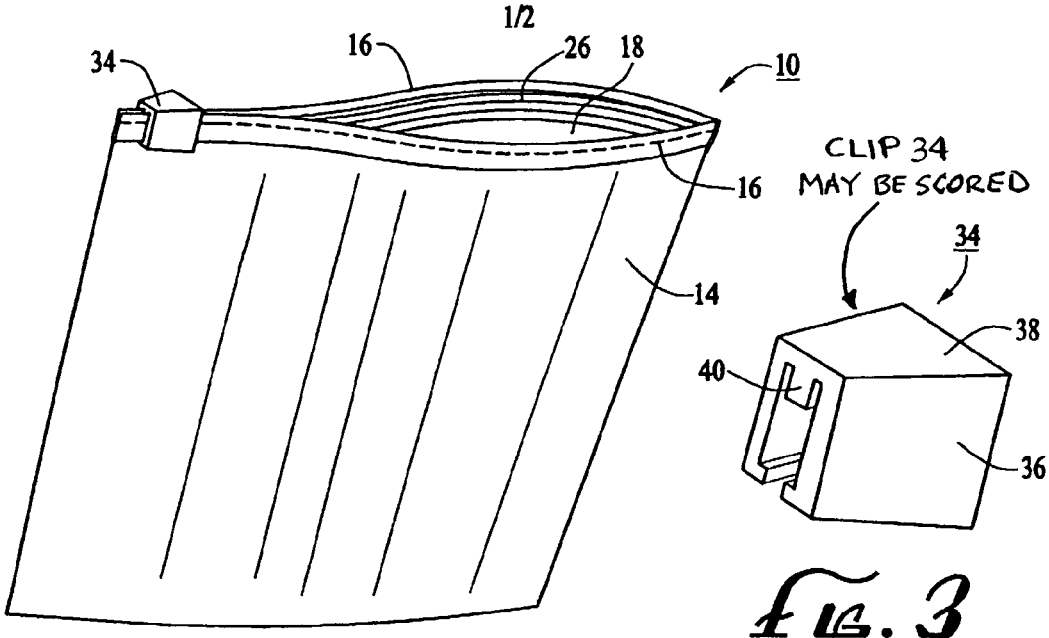
FIG. 1
FIG. 3
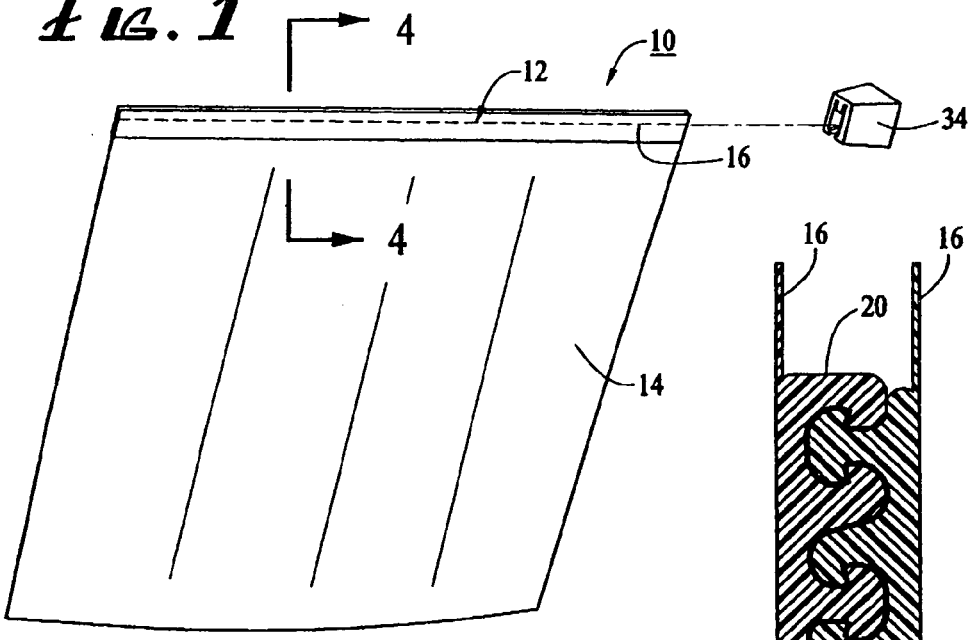
FIG. 2
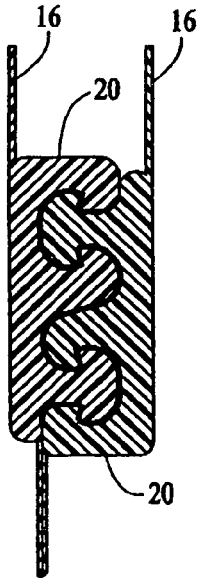
FIG. 4

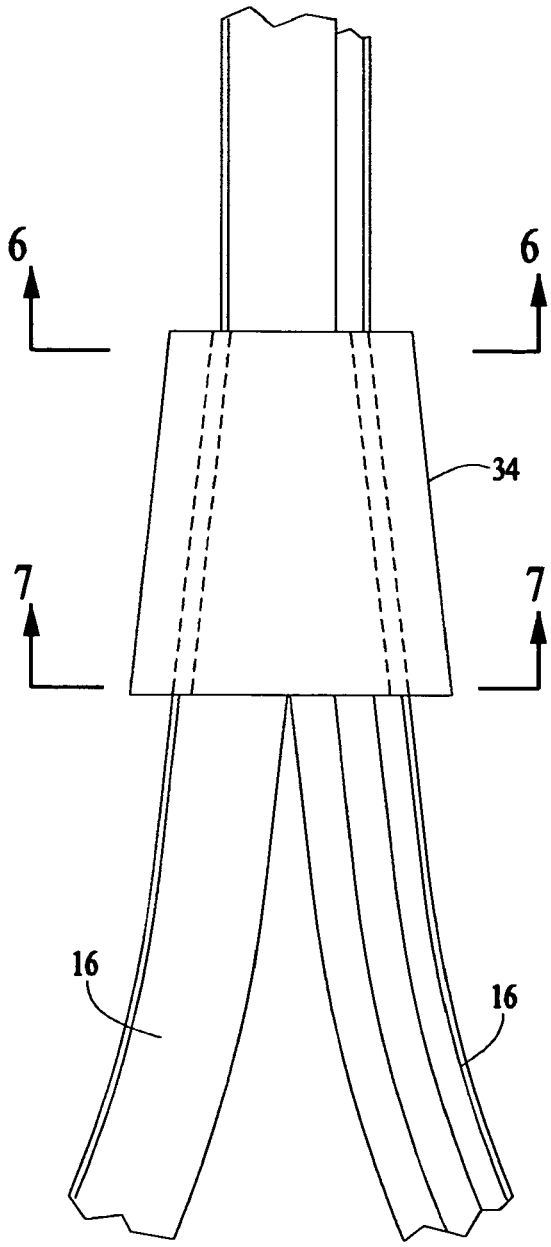
FIG. 5
FIG. 6
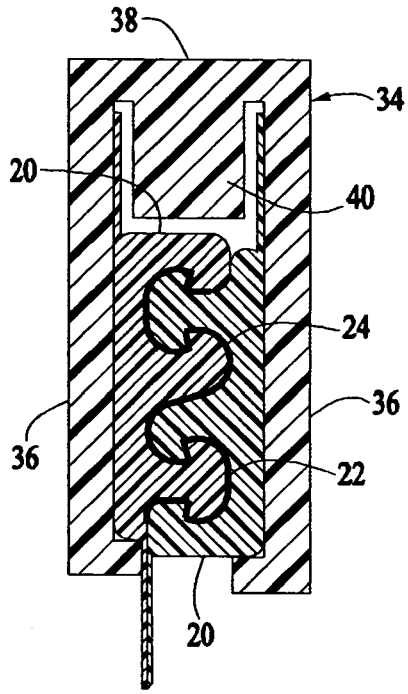
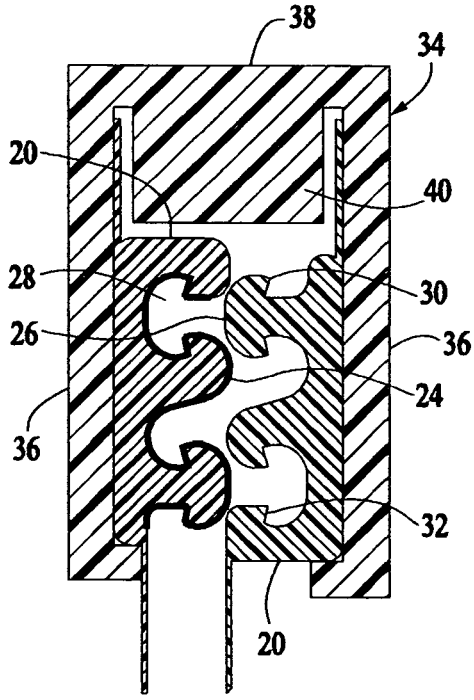
FIG. 7

LOCKABLE BAG WITH PLASTIC ZIPPER CLOSURE AND ZIPPER CLOSURE CLIP

FIELD OF THE INVENTION

This invention relates generally to lockable bags and, more specifically, to lockable bags having zipper closures.

BACKGROUND OF THE INVENTION

Lockable bags having zipper closures have become popular for a wide variety of applications, such as for permanently retaining forensic evidence and for permanently retaining hazardous medical wastes.

A very popular bag of this type has a plastic zipper. Typically, such bags are entirely made of plastic, but this is not necessary. One such locking bag having a plastic zipper is disclosed in U.S. Pat. No. 5,851,071, the entirety of which is incorporated herein by this reference.

Also popular today are re-openable plastic, zippered bags having a zipper closure clip adapted to both zip and unzip the bag.

It would be desirable to incorporate a zipper closure clip into a locking bag with a plastic zipper, wherein the zipper closure clip is not capable of unlocking the plastic zipper.

SUMMARY

The invention satisfies this need. The invention is a locking bag comprising (a) a plurality of walls forming an envelope with a single opening defined between a single pair of side wall edges, (b) a plastic zipper moiety disposed along each of the single pair of side wall edges at the opening, the pair of zipper moieties being adapted to nest with one another so as to be capable of zip-closing the opening, the zipper moieties having means to make the closing of the opening permanent, (c) a zipper closure clip slidably attached to the single pair of side wall edges at one corner of the opening, the zipper closure clip having a pair of opposed clamping surfaces which squeeze the single pair of side wall edges so as to force the zipper moieties together and to thereby permanently close the opening when the zipper closure clip is slid along the single pair of side wall edges.

DRAWINGS

These features, aspects and advantages of the present invention will become better understood with regard to the following description, appended claims and accompanying figures where:

FIG. 1 is an isometric view of a locking bag having features of the invention, showing the bag in an unlocked condition;

FIG. 2 is a second isometric view of the locking bag illustrated in FIG. 1, showing the bag in a locked condition;

FIG. 3 is an isometric view of a zipper closure clip useable in the invention;

FIG. 4 is a cross-sectional view of the plastic zipper portion of the bag illustrated in FIG. 2, taken along line 4—4;

FIG. 5 is a detail view of the zipper closure clip illustrated in FIG. 3, showing the zipper closure clip operating on the two sides of the bag opening to permanently close the bag opening;

FIG. 6 is a cross-sectional view of the zipper closure clip and plastic zipper illustrated in FIG. 5, taken along line 6—6; and FIG. 7 is a cross-sectional view of the zipper closure clip and plastic zipper illustrated in FIG. 5, taken along line 7—7.

DESCRIPTION OF THE INVENTION

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a locking bag 10 having a plastic zipper 12. The locking bag 10 has a plurality of walls 14. Some or all of the walls 14 are made of a flexible material such as a fabric or a flexible plastic. In a typical embodiment, all of the walls 14 are made of a flexible plastic, such as low density polyethylene or linear low density polyethylene. The material and thickness of the walls 14 are chosen to give sufficient strength to the walls 14, depending upon whatever service the bag 10 is to be used for.

The walls 14 are attached to one another at their respective edges to form an envelope. Where the walls 14 are principally fabric in material, the respective edges of the walls 14 can be attached to one another by sewing. Where the walls 14 are made of plastic, the respective edges of the walls 14 are typically attached to one another by one of the many plastic heat sealing processes known in the art.

A single pair of opposed side wall edges 16 are left unattached to one another to form a single opening 18 which allows access to the interior of the bag 10. A plastic zipper moiety 20 is disposed along each of the opposed single pair of side wall edges 16 at the opening 18. The two zipper moieties 20 are adapted to nest with one another so as to be capable of zip-closing the opening 18. By "zip-closing" of the opening 18, it is meant that the two zipper moieties 20 are adapted to nest in zipper fashion to form what it understood in the art to be a plastic zipper.

The two zipper moieties 20 include means 22 to make the closing of the opening 18 permanent when the two zipper moieties 20 are nested with one another. By the term "permanent" as applied to the closing of the opening 18, it is meant that, once the opening 18 is zip-closed, the opening 18 cannot be re-opened without tools or without tearing the walls 14 of the bag 10.

The means 22 for making the closing of the opening permanent can be provided by a suitable adhesive 24 disposed along one or both of the zipper moieties 20. Such an adhesive 24 is chosen to effect a suitably strong bond.

Alternatively, the means 22 for making the closing of the opening 18 permanent can be mechanical means provided by the configuration of the zipper moieties 22 themselves. Many such configurations are known in the art. One such configuration is illustrated in FIGS. 4, 6 and 7. As is the case with this configuration, a typical configuration capable of providing the means 22 to make the closing of the opening 18 permanent typically comprises a tongue 26 disposed on one of the two zipper moieties 20. The tongue 26 is sized and dimensioned to be firmly and permanently retained within a matching groove 28 disposed on the other of the two zipper moieties 20. As can be seen from FIGS. 4, 6 and 7, such a tongue and groove configuration can be made permanent by one or more elongate barb edges 30 which are firmly and permanently retained within a groove 28 having one or more elongate locking shoulders 32.

The locking bag 10 further comprises a zipper closure clip 34 which is slidably attached to the single pair of side wall edges 16 at one corner of the opening 18. The zipper closure clip 34 has a pair of opposed clamping surfaces 36 which are adapted to squeeze the single pair of side walls edges 16 so as to force the zipper moieties 20 together, and so as to thereby permanently close the opening 18 when the zipper closure clip 34 is slid along the single pair of side walls edges 16. In the embodiment illustrated in the drawings, the zipper closure clip 34 comprises a pair of opposed clamping surfaces 36 which depend downwardly from the outer edges of a top wall 38. As illustrated in the drawings, a guide prong 40 can be provided within the zipper closure clip 34 which depends downwardly from the center of the top wall 38 to guide the zipper closure clip 34 as it is slid along the single pair of side wall edges 16. Typically, the zipper closure clip 34 is made from a molded plastic material.

Unlike prior art zipper closure clips, the zipper closure clip 34 of the invention 10 is intentionally constructed without any means for reopening the bag 10 by the sliding of the zipper closure clip 34 in a direction opposite to the direction which closes the opening 18.

In one embodiment, the zipper closure clip 34 is readily removable from the single pair of side wall edges 16 without tools after the zipper closure clip 34 has been used to close the opening 18. In the embodiment illustrated in the drawings, the zipper closure clip 34 is merely slipped off the single pair of side wall edges 16 after the zipper closure clip 34 has been used to close the opening 18. In an alternative embodiment, the zipper closure clip 34 is constructed, such as by being scored, so that is can easily be broken away from the single pair of sidewall edges 16 without tools.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A locking bag comprising:

(a) a plurality of walls forming a bag with a single opening defined between a single pair of side wall edges;

(b) a plastic zipper moiety disposed along each of the single pair of side wall edges at the opening, the pair of zipper moieties being adapted to nest with one another so as to be capable of zip-closing the opening, the zipper moieties having means to make the closing of the opening permanent; and (c) a one way zipper closure clip slidably attached to straddle said single pair of side wall edges, the zipper closure clip having a top and a pair of opposed clamping surfaces which depend downwardly from the top thereby squeezing the single pair of side wall edges so as to force the zipper moieties together to thereby permanently close the opening when the zipper closure clip is slid along the single pair of side wall edges;

wherein the one-way zipper closure clip is constructed such that the opening is not reopened by sliding the zipper closure clip in a direction opposite to the direction which closes the opening; and wherein the zipper closure clip includes a guide prong depending from the top between the pair of opposed clamping surfaces, the guide prong and adjacent clamping surface forming a channel therebetween for receiving a portion of the sidewall edge extending above the zipper moiety.

2. A locking bag comprising:

(a) a plurality of walls forming a bag with a single opening defined between a single pair of side wall edges;

(b) a plastic zipper moiety disposed along each of the single pair of side wall edges at the opening, the pair of zipper moieties being adapted to nest with one another so as to be capable of zip-closing the opening, the zipper moieties having means to make the closing of the opening permanent; and (c) a one way zipper closure clip slidably attached to straddle said single pair of side wall edges, the zipper closure clip having a top and a pair of opposed clamping surfaces which depend downwardly from the top thereby squeezing the single pair of side wall edges so as to force the zipper moieties together to thereby permanently close the opening when the zipper closure clip is slid along the single pair of side wall edges;

wherein the one-way zipper closure clip is constructed such that the opening is not reopened by sliding the zipper closure clip in a direction opposite to the direction which closes the opening; and wherein the zipper closure clip includes a guide prong depending from the top between the pair of opposed clamping surfaces, the guide prong depending towards the zipper moieties between the opposed clamping surfaces and not extending down between the zipper moieties so as to not reopen the zipper moieties when the zipper closure clip is slid in a direction opposite to the direction which closes the opening.

3. A locking bag comprising:

(a) a plurality of walls forming an envelope with a single opening defined between a single pair of side wall edges;

(b) a plastic zipper moiety disposed along each of the single pair of side wall edges at the opening, the pair of zipper moieties being adapted to nest with one another so as to be capable of zip-closing the opening, the zipper moieties having means to make the closing of the opening permanent; and (c) a zipper closure clip slidably attached to the single pair of side wall edges at one corner of the opening, the zipper closure clip having a top wall and a pair of opposed clamping surfaces which depend downwardly from the outer edges of the top wall thereby squeezing the single pair of side wall edges so as to force the zipper moieties together to thereby permanently close the opening when the zipper closure clip is slid along the single pair of side wall edges;

wherein the zipper closure clip is removable from the single pair of side wall edges, without tools, after the zipper closure clip has been slid along the single pair of side wall edges to permanently close the opening, by slipping the zipper closure clip off the single pair of side wall edges, or by breaking away the zipper closure clip from the single pair of side wall edges; and wherein the zipper closure clip includes a guide prong depending from the top wall between the pair of opposed clamping surfaces, the guide prong and adjacent clamping surface forming a channel therebetween for receiving a portion of the sidewall edge extending above the zipper moiety.

4. A locking bag comprising:

(a) a plurality of walls forming an envelope with a single opening defined between a single pair of side wall edges;

(b) a plastic zipper moiety disposed along each of the single pair of side wall edges at the opening, the pair of zipper moieties being adapted to nest with one another so as to be capable of zip-closing the opening, the zipper moieties having means to make the closing of the opening permanent; and (c) a zipper closure clip slidably attached to the single pair of side wall edges at one corner of the opening, the zipper closure clip having a top wall and a pair of opposed clamping surfaces which depend downwardly from the outer edges of the top wall thereby squeezing the single pair of side wall edges so as to force the zipper moieties together to thereby permanently close the opening when the zipper closure clip is slid along the single pair of side wall edges;

wherein the zipper closure clip is removable from the single pair of side wall edges, without tools, after the zipper closure clip has been slid along the single pair of side wall edges to permanently close the opening, by slipping the zipper closure clip off the single pair of side wall edges, or by breaking away the zipper closure clip from the single pair of side wall edges; and wherein the zipper closure clip includes a guide prong depending from the top wall between the pair of opposed clamping surfaces, the guide prong depending towards the zipper moieties between the opposed clamping surfaces and not extending down between the zipper moieties so as to not reopen the zipper moieties when the zipper closure clip is slid in a direction opposite to the direction which closes the opening.

5. A locking bag comprising:

(a) a plurality of walls forming an envelope with a single opening defined between a single pair of side wall edges:

(b) a plastic zipper moiety disposed along each of the single pair of side wall edges at the opening, the pair of zipper moieties being adapted to nest with one another so as to be capable of zip-closing the opening, the zipper moieties having means to make the closing of the opening permanent; and (c) a zipper closure clip slidably attached to the single pair of side wall edges at one corner of the opening, the zipper closure clip having a top wall and a pair of opposed clamping surfaces which depend downwardly from the outer edges of the top wall, said clip being constructed to squeeze the single pair of side wall edges so as to force the zipper moieties together to thereby permanently close the opening when the zipper closure clip is slid along the single pair of side wall edges;

wherein the zipper closure clip is removable from the single pair of side wall edges, without tools, after the zipper closure clip has been slid along the single pair of side wall edges to permanently close the opening, by slipping the zipper closure clip off the single pair of side wall edges, or by breaking away the zipper closure clip from the single pair of side wall edges;

wherein a lip is disposed on the bottom of each of the opposed clamping surfaces extending towards the opposite clamping surface so as to contact a bottom surface of an adjacent zipper moiety to thereby provide the closure clip in the slidably attached relationship to the pair of side wall edges.

6. A locking bag comprising:

(a) a plurality of walls forming an envelope with a single opening defined between a single pair of side wall edges;

(b) a plastic zipper moiety disposed along each of the single pair of side wall edges at the opening, the pair of zipper moieties being adapted to nest with one another so as to be capable of zip-closing the opening, the zipper moieties having means to make the closing of the opening permanent; and (c) a zipper closure clip slidably attached to the single pair of side wall edges, the zipper closure clip having a top and a pair of opposed clamping surfaces which depend downwardly from the top, said clip being constructed to squeeze the single pair of side wall edges so as to force the zipper moieties together to thereby permanently close the opening when the zipper closure clip is slid along the single pair of side wall edges;

wherein the zipper closure clip is constructed to close the opening when the closure clip is slid along the single pair of side wall edges in one direction, said closure clip not having means to reopen the opening by sliding the closure clip in a direction opposite to the direction which closes the opening;

wherein a lip is disposed on the bottom of each of the opposed clamping surfaces extending towards the opposite clamping surface so as to contact a bottom surface of an adjacent zipper moiety to thereby provide the closure clip in the slidably attached relationship to the pair of side wall edges.

7. A locking bag comprising:

(a) a plurality of walls forming a bag with a single opening defined between a single pair of side wall edges;

(b) a plastic zipper moiety disposed along each of the single pair of side wall edges at the opening, the pair of zipper moieties being adapted to nest with one another so as to be capable of zip-closing the opening, the zipper moieties having means to make the closing of the opening permanent; and (c) a one way zipper closure clip slidably attached to straddle said single pair of side wall edges, the zipper closure clip having a top and a pair of opposed clamping surfaces which depend downwardly from the top, said clip being constructed to squeeze the single pair of side wall edges so as to force the zipper moieties together to thereby permanently close the opening when the zipper closure clip is slid along the single pair of side wall edges;

wherein the one-way zipper closure clip is constructed to close the opening when the closure clip is slid along the single pair of side wall edges in one direction, said closure clip not having means to reopen the opening by sliding the closure clip in a direction opposite to the direction which closes the opening;

wherein a lip is disposed on the bottom of each of the opposed clamping surfaces extending towards the opposite clamping surface so as to contact a bottom surface of an adjacent zipper moiety to thereby provide the closure clip in the slidably attached relationship to the pair of side wall edges.

8. A locking bag comprising:

(a) a plurality of walls forming an envelope with a single opening defined between a single pair of side wall edges;

(b) a plastic zipper moiety disposed along each of the single pair of side wall edges at the opening, the pair of zipper moieties being adapted to nest with one another so as to be capable of zip-closing the opening, the zipper moieties having means to make the closing of the opening permanent; and (c) a zipper closure clip slidably attached to the single pair of side wall edges at one corner of the opening, the zipper closure clip having a top wall and a pair of opposed clamping surfaces which depend downwardly from the outer edges of the top wall, said clip being constructed to squeeze the single pair of side wall edges so as to force the zipper moieties together to thereby permanently close the opening when the zipper closure clip is slid along the single pair of side wall edges;

wherein the zipper closure clip is removable from the single pair of side wall edges, without tools, after the zipper closure clip has been slid along the single pair of side wall edges to permanently close the opening, by slipping the zipper closure clip off the single pair of side wall edges, or by breaking away the zipper closure clip from the single pair of side wall edges;

wherein the zipper closure clip has a first end and a second end with the opposed clamping surfaces extending between the first end and the second end, wherein the opposed clamping surfaces are spaced apart a first distance at the first end of the closure clip and spaced apart a second distance at the second end of the closure clip, wherein the first distance is greater than the second distance.

9. A locking bag comprising:

(a) a plurality of walls forming an envelope with a single opening defined between a single pair of side wall edges;

(b) a plastic zipper moiety disposed along each of the single pair of side wall edges at the opening, the pair of zipper moieties being adapted to nest with one another so as to be capable of zip-closing the opening, the zipper moieties having means to make the closing of the opening permanent; and (c) a zipper closure clip slidably attached to the single pair of side wall edges, the zipper closure clip having a top and a pair of opposed clamping surfaces which depend downwardly from the top, said clip being constructed to squeeze the single pair of side wall edges so as to force the zipper moieties together to thereby permanently close the opening when the zipper closure clip is slid along the single pair of side wall edges;

wherein the zipper closure clip is constructed to close the opening when the closure clip is slid along the single pair of side wall edges in one direction, said closure clip not having means to reopen the opening by sliding the closure clip in a direction opposite to the direction which closes the opening;

wherein the zipper closure clip has a first end and a second end with the opposed clamping surfaces extending between the first end and the second end, wherein the opposed clamping surfaces are spaced apart a first distance at the first end of the closure clip and spaced apart a second distance at the second end of the closure clip, wherein the first distance is greater than the second distance.

10. A locking bag comprising:

(a) a plurality of walls forming a bag with a single opening defined between a single pair of side wall edges;

(b) a plastic zipper moiety disposed along each of the single pair of side wall edges at the opening, the pair of zipper moieties being adapted to nest with one another so as to be capable of zip-closing the opening, the zipper moieties having means to make the closing of the opening permanent; and (c) a one way zipper closure clip slidably attached to straddle said single pair of side wall edges, the zipper closure clip having a top and a pair of opposed clamping surfaces which depend downwardly from the top, said clip being constructed to squeeze the single pair of side wall edges so as to force the zipper moieties together to thereby permanently close the opening when the zipper closure clip is slid along the single pair of side wall edges;

wherein the one-way zipper closure clip is constructed to close the opening when the closure clip is slid along the single pair of side wall edges in one direction, said closure clip not having means to reopen the opening by sliding the closure clip in a direction opposite to the direction which closes the opening;

wherein the zipper closure clip has a first end and a second end with the opposed clamping surfaces extending between the first end and the second end, wherein the opposed clamping surfaces are spaced apart a first distance at the first end of the closure clip and spaced apart a second distance at the second end of the closure clip, wherein the first distance is greater than the second distance.

11. A locking bag comprising:

(a) a plurality of walls forming an envelope with a single opening defined between a single pair of side wall edges;

(b) a plastic zipper moiety disposed along each of the single pair of side wall edges at the opening, the pair of zipper moieties being adapted to nest with one another so as to be capable of zip-closing the opening, the zipper moieties having means to make the closing of the opening permanent; and (c) a zipper closure clip slidably attached to the single pair of side wall edges at one corner of the opening, the zipper closure clip having a top wall and a pair of opposed clamping surfaces which depend downwardly from the outer edges of the top wall, said clip being constructed to squeeze the single pair of side wall edges so as to force the zipper moieties together to thereby permanently close the opening when the zipper closure clip is slid along the single pair of side wall edges;

wherein the zipper closure clip is removable from the single pair of side wall edges, without tools, after the zipper closure clip has been slid along the single pair of side wall edges to permanently close the opening, by slipping the zipper closure clip off the single pair of side wall edges, or by breaking away the zipper closure clip from the single pair of side wall edges;

wherein said clip has an interior channel that is tapered to converge from a leading edge to a trailing edge, said taper being sized so that said zipper moieties move from a disengaged position to an engaged position when passing through said leading edge to said trailing edge respectively.

* * * * *